US006485274B2

(12) United States Patent
Kösters

(10) Patent No.: US 6,485,274 B2
(45) **Date of Patent: *Nov. 26, 2002**

(54) DISPLACEMENT MACHINE FOR COMPRESSIBLE MEDIA

(75) Inventor: Heiner Kösters, Itzehoe (DE)

(73) Assignee: Sterling Fluid Systems (Germany) GmbH, Itzehoe (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/572,102

(22) Filed: May 17, 2000

(65) Prior Publication Data

US 2002/0141886 A1 Oct. 3, 2002

(30) Foreign Application Priority Data

May 18, 1999 (EP) ..... 99109792

(51) Int. Cl.[7] ..... F04B 17/00; F04B 35/04
(52) U.S. Cl. ..... 417/410.4; 417/212; 417/16
(58) Field of Search ..... 417/410.4, 212, 417/16

(56) References Cited

U.S. PATENT DOCUMENTS 4,490,102 A 12/1984 Carré et al. ..... 418/201
5,417,551 A * 5/1995 Abe et al. ..... 417/203
5,709,537 A 1/1998 Maruyama et al. ..... 417/410.4
5,836,746 A * 11/1998 Maruyama et al. ..... 417/44.1

FOREIGN PATENT DOCUMENTS

FR 1039761 7/1951
GB 343344 3/1980

OTHER PUBLICATIONS

European Search Report corresponding to European Patent Application No. EP 99 10 9792 dated Sep. 28, 1999.

* cited by examiner

*Primary Examiner*—Charles G. Freay
*Assistant Examiner*—W. Rodriguez
(74) *Attorney, Agent, or Firm*—Alix, Yale & Ristas, LLP

(57) ABSTRACT

A displacement machine for compressible media includes at least two shafts. Each of the shafts has a rotor which is configured as a profiled body with the profiles of the rotors engaging one another in the manner of gearwheels during rotation and running without contact relative to one another. Each of the shafts is driven by an electric motor. The angular positions of each shaft is determined by an associated synchro resolver. Each of the synchro resolvers has a rotor and emits an electronic signal to the electric motor of the shaft such that the motors are electronically synchronized. Each of the shafts further has a gearwheel, with the gearwheels engaging one another and having an angular clearance which is smaller than that of the profiled bodies. At least one of the gearwheels is directly connected to the rotor of the synchro resolver associated with its shaft and both gearwheels together are releasably connected as a unit to the shaft.

11 Claims, 2 Drawing Sheets

5
1
4
4
2
6
6
2
8
8
7
3
3
7
15
Differential Control

DISPLACEMENT MACHINE FOR COMPRESSIBLE MEDIA

BACKGROUND OF THE INVENTION

The invention relates to a displacement machine for compressible media, in particular a dry-running vacuum pump, having at least two shafts with rotors, which are configured as profiled bodies and whose profiles engage with one another in the manner of gearwheels during rotation and run without contact relative to one another, each of the shafts being driven by its own electric motor, the angular positions of the shafts being determined by synchro resolvers, on the basis of whose signals the motors are electronically synchronized, and the shafts having gearwheels, which engage with one another and whose angular clearance is smaller than that of the profiled bodies.

For a long time, it was usual to synchronize the rotors of such displacement machines by means of gearwheels, only one motor being normally provided. It was, however, necessary to lubricate the gearwheels so that it was only possible to avoid pollution of the pumped medium by means of a very high level of complication in the sealing of the gear relative to the rotors and the actual pump space. However, the corresponding seals wear out so that the pump had to be taken apart in more or less regular intervals in order to replace the seals.

These problems are avoided, in a pump of the type mentioned at the beginning (U.S. Pat. No. 5,836,746), by each of the rotors being driven by its own electric motor and these being electronically synchronized. The angular positions of the two shafts are continuously determined by synchro resolvers. The synchro resolver signals are supplied to an electronic unit, which drives the two electric motors synchronously in such a way that the rotors cannot come into contact. In order to ensure, under adverse operating conditions with the synchronization operating inaccurately, that the rotors do not come into contact, which would lead to damage to the surfaces of the same, a gearwheel is provided on each shaft in this pump. The two gearwheels engage with one another and have a smaller angular clearance than the profiled bodies. If, therefore, the electronic synchronization fails, the gearwheels, which run without contact in normal operation, come into contact first. The profiled bodies, however, still cannot come into contact because they have an angular clearance which is greater than that of the gearwheels.

One problem in a displacement machine of this type consists in setting the rotors and gearwheels in such a way that, during operation, the flanks of both rotors and gearwheels have the largest possible distance apart. In the ideal case, the position of the rotors and the gearwheels should be such that the rotors take up an angular position relative to one another which is located in the center between the two angular positions at which contact occurs. The same applies to the gearwheels. In normal operation, the displacement machine would then be operated with this "null position". This setting, however, is very difficult to effect. A setting operation by mechanical means is laborious and inaccurate because the angular clearance between the gearwheels and between the rotors is only very small, and must only be very small, so that the gap between the profiled bodies, through which a reverse flow occurs during pumping, is as small as possible.

In a displacement machine of the type mentioned at the beginning (U.S. Pat. No. 5,417,551 A), setting of the gearwheels to the average of the angular positions at which the gearwheels come into contact does in fact occur. The citation does not, however, show how the critical setting can be achieved such that the average of the two angular settings at which the flanks of the rotor come into contact coincides with the average of the corresponding angular positions of the gearwheels. It is only then, however, that unproblematic operation is possible. The citation only describes how the average of the angular positions of the gearwheels is set. It is then assumed that the average values for the rotors and the average values for the gearwheels coincide. It is, indeed, stated that the clearance of the gearwheels on one side must not be larger than that on the other because otherwise the rotors would come into contact. Such a problem, however, only occurs if the central points of the rotors and the gearwheels do not coincide. If this problem occurs, this can only take place by a relative angular adjustment between the rotors and the gearwheels but no information on such an adjustment is provided by the citation. In addition, such an adjustment may not be possible because the gearwheels are located far within the machine, the angular sensors are located more or less at the end of the corresponding shaft and the gearwheel and rotor of the corresponding angular sensor are not directly connected to one another.

SUMMARY OF THE INVENTION

The object of the invention consists in creating a displacement machine, of the type mentioned at the beginning, in which the "null position" of the rotors and the gearwheels can be set simply, rapidly and accurately by means of the synchro resolvers.

The solution according to the invention consists in the fact that at least one of the gearwheels is directly connected to the rotor of the synchro resolver of its shaft and both together are releasably connected as a unit to the shaft.

The setting of the "null position" and of the flank clearance takes place, in accordance with the invention, in the following way. One rotor, to which the gearwheel and the synchro resolver are releasably fastened, is first held steady. The gearwheel can then execute a rotary motion relative to the shaft of this one rotor. The other rotor is then rotated in both rotational directions as far as a position in which the flanks of the profiled bodies come into contact.

The two contact angles are measured, and the rotor with its gearwheel fastened to it is set to the central position between these two angles and held steady.

The first rotor, likewise, is still held steady. The gearwheel of the first rotor, however, is now rotated in both directions to the point where, in each case, it comes into contact with the gearwheel of the other rotor. The contact angles are likewise again established. The gearwheel is then set to the central value between these two contact points and firmly connected to the corresponding shaft; it is, in particular, firmly clamped by tightening bolts. Both the rotors, or profiled bodies, and the gearwheels are therefore located exactly in the central position between the two positions in which they are in contact or would be in contact. This is the null position used to carry out the synchronization, the control being carried out in such a way that the relative position of the two shafts, rotors and gearwheels corresponds, as far as possible, to this value during continuous operation.

The gearwheels are advantageously attached at one shaft end because they are then particularly easily accessible, which facilitates the fastening of the initially loosened gearwheel to its shaft.

The displacement machine advantageously has a differential control for the rotational speed of the motors. Well-synchronized operation has already been achieved by the synchronization according to the invention, be means of the setting of the flank clearance and the "null position". The operational behavior is further improved if the two rotors are synchronized not to an independently specified required value but, rather, if the synchronization takes place mainly on the basis of differences in the angular positions. If, for example, liquid penetrates into the pump space, the rotors are greatly retarded because the density of the liquid is approximately a thousand times greater relative to gases with the retardation, however, taking place approximately equally for both rotors. Compensation for possibly occurring differences can then be provided by means of the synchronization. This would not be the case if the synchronization were to take place to an externally specified value. However, an additional external control does, of course, occur in order to permit input of the desired rotational speed. This control, however, which acts in the same sense on both motors, is relatively slow so that rapid rotational speed differences are obviated by the differential control.

It has been found particularly expedient for the drive if the motors are three-phase motors with permanent magnet rotors.

BRIEF DESCRIPTION OF THE DRAWINGS

The invention is described below using an advantageous embodiment with reference to the attached drawings. In these.

DETAILED DESCRIPTION OF THE PREFERRED EMBODIMENT

Figure 1:
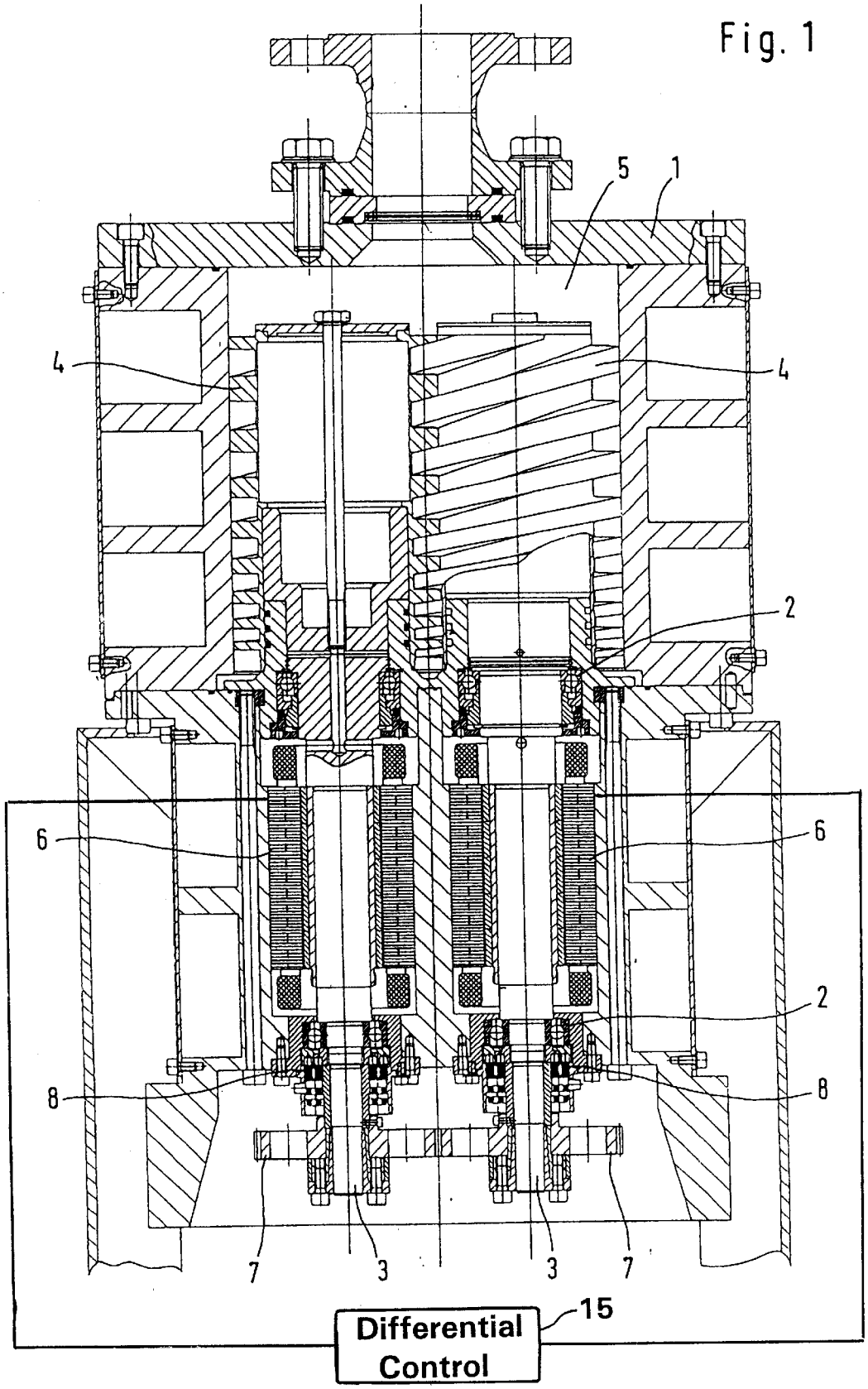
FIG. 1 shows, in cross section, a displacement machine according to the invention.

As is shown in FIG. 1, two shafts 3 are supported by bearings 2 in a pump housing 1, which is built up from a plurality of parts. Fastened to the shafts 3 are profiled bodies 4, which engage in one another and, in the pump space 5, induce from above the medium to be pumped through a connection and expel the medium at the bottom through openings which are not shown. The shafts 3 and the profiled bodies 4 are driven by electric motors 6, a separate electric motor 6 being provided for each shaft 3. Two gearwheels 7, which engage in one another, are provided at the bottom on the shafts 3. The motors 6 are electronically synchronized by means of synchro resolvers 8. In the case of adverse operating conditions, if the electronic synchronization is not sufficient, the gearwheels 7 come into contact first because they have an angular clearance which is smaller than that of the rotors 4. The gearwheels 7 do not normally come into contact so that it is possible to dispense with lubrication of these gearwheels.

Figure 2:
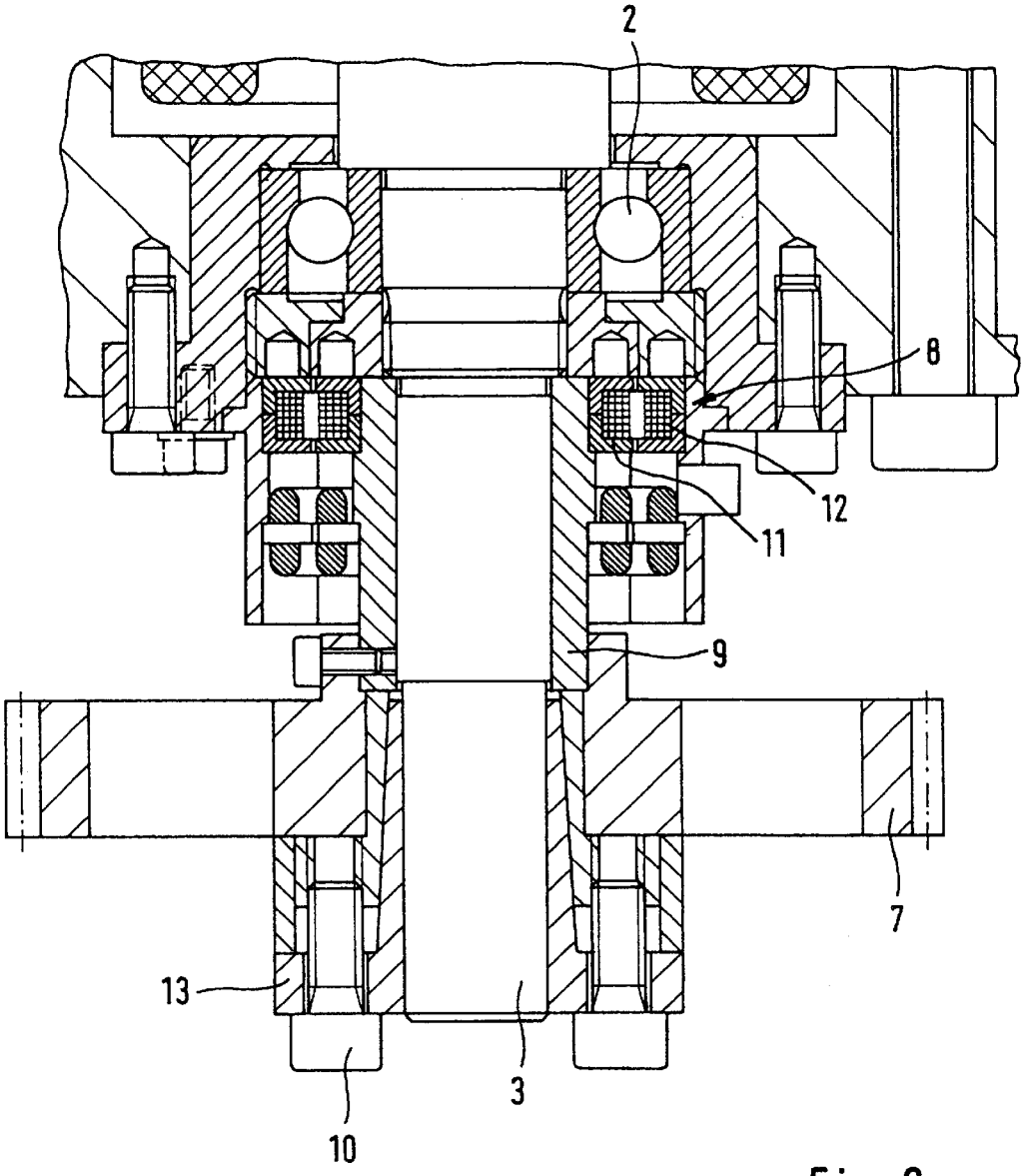
FIG. 2 shows an enlarged representation of the arrangement, according to the invention, of the synchro resolvers.

FIG. 2 shows an excerpt from the representation of FIG. 1 to an enlarged scale. On the right-hand shaft 3, the gearwheel 7 is connected to the synchro resolver rotor 11, which can be rotated relative to the shaft 3. The gearwheel 7 can, in turn, be fixed on the shaft 3 by means of the clamping element 13. The rotor 11 of the synchro resolver 8 is arranged on the sleeve 9 whereas the stator 12 of the synchro resolver 8 is arranged to be fixed relative to the housing.

In order to set the ideal position or the null position of both the rotors 4 and the gearwheels 7, the rotor 4 and its shaft 3 on the right-hand side in FIG. 1 are first held steady, the bolt 10 being loosened so that the right-hand gearwheel 7 can rotate. The left-hand shaft 3 is then rotated in both directions until the rotors 4 come into contact, these two contact angles being determined by means of the synchro resolver 8. The left-hand shaft 3 is then set to the average value between these two contact points. The right-hand shaft 3 of the right-hand rotor continues to be held steady. The gearwheel 7 located on the right is then moved in both directions until it comes into contact with the left-hand gearwheel. The two contact angles are measured by means of the right-hand synchro resolver 8. The gearwheel 7 is then set to the average value between these two angles and is tightened by means of the bolt 10. The two rotors 4 and the two gearwheels 7 are therefore located in the central position between the contact points. The operation is then synchronized to this value of the relative angles.

The displacement machine advantageously has a differential control (15) for the rotational speed of the motors (6). Well-synchronized operation has already been achieved by the synchronization according to the invention, be means of the setting of the flank clearance and the "null position". The operational behavior is further improved if the two rotors (4) are synchronized not to an independently specified required value but, rather, if the synchronization takes place mainly on the basis of differences in the angular positions. If, for example, liquid penetrates into the pump space (5), the rotors (4) are greatly retarded because the density of the liquid is approximately a thousand times greater relative to gases with the retardation, however, taking place approximately equally for both rotors (4). Compensation for possibly occurring differences can then be provided by means of the synchronization. This would not be the case if the synchronization were to take place to an externally specified value. However, an additional external control does, of course, occur in order to permit input of the desired rotational speed. This control, however, which acts in the same sense on both motors (6), is relatively slow so that rapid rotational speed differences are obviated by the differential control (15).

What is claimed is:

1. Displacement machine for compressible media having at least two shafts, each of the shafts having a rotor which is configured as a profiled body, the profiles of the rotors engaging one another in the manner of gearwheels during rotation and running without contact relative to one another, each of the shafts having and being driven by an electric motor, the angular positions of each shaft being determined by an associated synchro resolver, each of the synchro resolvers having a rotor and emitting an electronic signal to the electric motor of the shaft whereby the motors are electronically synchronized, each of the shafts further having a gearwheel, the gearwheels engaging one another and having an angular clearance which is smaller than that of the profiled bodies, wherein at least one of the gearwheels is connected to the rotor of the synchro resolver associated with its shaft and the rotor of the synchro and the gearwheel connected thereto define a unit, said unit being releasably connected to the shaft.

2. Displacement machine according to claim 1, wherein the shaft has oppositely disposed end portions and the gearwheels are attached at one shaft end portion.

3. Displacement machine according to claim 1 further comprising a differential control for controlling the rotational speed of the motors.

4. Displacement machine according to claim 1, wherein the motors are three-phase motors with permanent magnet rotors.

5. Displacement machine according to claim 2, further comprising a differential control for controlling the rotational speed of the motors.

6. Displacement machine according to claim 2, wherein the motors are three-phase motors with permanent magnet rotors.

7. In a displacement machine for compressible media having first and second displacement elements and a synchro resolver associated with each displacement element, each displacement element comprising a shaft, a rotor having a profiled body and a gearwheel, the shaft being rotatable about an axis, the rotor and gearwheel being mounted to the shaft, the rotor and gearwheel of the first displacement element engaging the rotor and gearwheel of the second displacement element during rotation, a method of setting the null position of the rotors and the gearwheels comprising the steps of:

(1) dismounting the gearwheel of the first displacement element from the shaft of the first displacement element whereby the gearwheel is rotatable about the shaft;

(2) holding the shaft and rotor of the first displacement element steady, (a) rotating the second displacement element in a first direction about the axis until the rotor of the second displacement element is at a first point of contact with the rotor of the first displacement device, (b) rotating the second displacement element in an opposite direction about the axis until the rotor of the second displacement element is at a second point of contact with the rotor of the first displacement device;

(3) rotating the second displacement element about the axis until the rotor of the second displacement element is positioned at a midpoint between the first and second points of contact;

(4) holding the shaft of the first displacement element steady, (a) rotating the gearwheel of the first displacement element in a first direction about the axis until the gearwheel of the first displacement element is at a first point of contact with the gearwheel of the second displacement device, (b) rotating the gearwheel of the first displacement element in an opposite direction about the axis until the gearwheel of the first displacement element is at a second point of contact with the gearwheel of the second displacement device; and (5) rotating the gearwheel of the first displacement element about the rotor until the gearwheel of the first displacement element is positioned at a midpoint between the first and second points of contact.

8. The method of claim 7 wherein step (2) also comprises the sub-step of:

(c) measuring contact angles at the first and second points of contact with the synchro resolver associated with the second displacement element.

9. The method of claim 8 wherein step (2) also comprises the sub-step of:

(d) computing the midpoint from the measured contact angles.

10. The method of claim 7 wherein step (4) also comprises the sub-step of:

(c) measuring contact angles at the first and second points of contact with the synchro resolver associated with the first displacement element.

11. The method of claim 10 wherein step (4) also comprises the sub-step of:

(d) computing the midpoint from the measured contact angles.

* * * * *